US006427422B2

(12) United States Patent
Nakagawa et al.

(10) Patent No.: US 6,427,422 B2
(45) **Date of Patent: *Aug. 6, 2002**

(54) PACKAGING METHOD

(75) Inventors: Yukio Nakagawa; Masashi Kondo, both of Shiga (JP)

(73) Assignee: Ishida Co., Ltd., Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/359,490

(22) Filed: Jul. 22, 1999

(30) Foreign Application Priority Data

Jul. 23, 1998 (JP) ..... 10-207977

(51) Int. Cl.[7] ..... B65B 1/22; B65B 9/00
(52) U.S. Cl. ..... 53/437; 53/451
(58) Field of Search ..... 53/409, 436, 437, 53/451, 495, 501, 502, 503; 700/304, 305

(56) References Cited

U.S. PATENT DOCUMENTS 1,353,210 A * 9/1920 Bates ..... 53/437
3,525,193 A * 8/1970 Cutler et al. ..... 53/437
4,508,185 A * 4/1985 Minamida et al. ..... 700/305
5,125,213 A * 6/1992 Focke et al. ..... 53/437
5,235,794 A * 8/1993 Center ..... 53/437
5,540,035 A 7/1996 Plahm et al.
5,753,067 A * 5/1998 Fukuda et al. ..... 53/451
6,119,438 A * 9/2000 Bacon et al. ..... 53/451

FOREIGN PATENT DOCUMENTS

| | | |
|---|---|---|
| GB | 1278562 | 1/1970 |
| WO | WO 94/13537 | 6/1994 |
| WO | WO 97/02179 | 1/1997 |

* cited by examiner

*Primary Examiner*—Stephen F. Gerrity
*Assistant Examiner*—Louis Huynh
(74) *Attorney, Agent, or Firm*—Beyer Weaver & Thomas LLP

(57) ABSTRACT

Packages are each made by clamping a tubularly formed bag-making film, dropping a batch of articles into this film while it is in this clamped condition, and shaking this batch of articles to thereby increase its volume density. This is done once or repeated any number of times. After articles of the final batch are dropped into the film, the clamped condition of the film is released and the articles are dropped further downward to the bottom of the bag being made. The tubularly formed film is thereafter sealed transversely above the articles which have been received to close the bag.

7 Claims, 6 Drawing Sheets

1
2
100
3
32
31
33
5
67
66
57
10
INPUT
710
59
CONTROL
7
7
710
71
71
9
74
73

PACKAGING METHOD

BACKGROUND OF THE INVENTION

This invention relates to a method of making packages by means of a packaging machine. More particularly, this invention relates to a method of making packages by increasing the volume density of the articles that are to be packaged.

Packages of articles which are easily breakable and low in volume density, such as potato chips, are difficult to handle efficiently because a large amount of package-making material is required to package them and the costs of their transportation are high. In view of this problem, U.S. Pat. No. 5,540,035, for example, disclosed a method of shaking the articles which have been dropped into a bag before it is sealed such that the volume of the batch of articles to be sealed in is reduced. If this technology is applied to a large-scale packaging machine adapted to package twice or three times more articles in each bag than a packaging machine of a normal size, however, it is not possible to effectively increase the volume density of articles inside the bag, and the packaging speed is adversely affected significantly.

SUMMARY OF THE INVENTION

It is therefore an object of this invention in view of this problem of the prior art technology to provide an improved method of producing large packages while efficiently increasing the volume density of the articles.

A packaging method embodying this invention, with which the above and other objects can be accomplished, may be characterized as comprising the steps of clamping a tubularly formed bag-making film with a shaking mechanism (herein referred to as the shaker), dropping a batch of articles into this film while it is in this clamped condition, and shaking this batch of articles by activating the shaker to thereby increase its volume density. This is done once or repeated any number of times, and after articles of the final batch are dropped into the film, the clamped condition of the film is released and the articles are dropped further downward to the bottom of the bag being made. The tubularly formed film is thereafter sealed transversely above the batches of articles which have been dropped to close the bag.

The user may use an input device to input various packaging conditions such as the length of each bag to be made and the packaging speed (that is, the number of packages to be produced per unit time). A packaging machine according to this invention includes a control unit which determines whether the film should be transported intermittently or continuously by comparing at least one of the inputted packaging conditions and a preliminarily stored value such as a packaging speed. The steps described above are carried out if the control unit concludes that the film should be transported in an intermittent mode. If the control unit concludes that the film should be transported in a continuous mode, the film is pulled down in a continuous motion without subjected to the shaking by the shaker.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
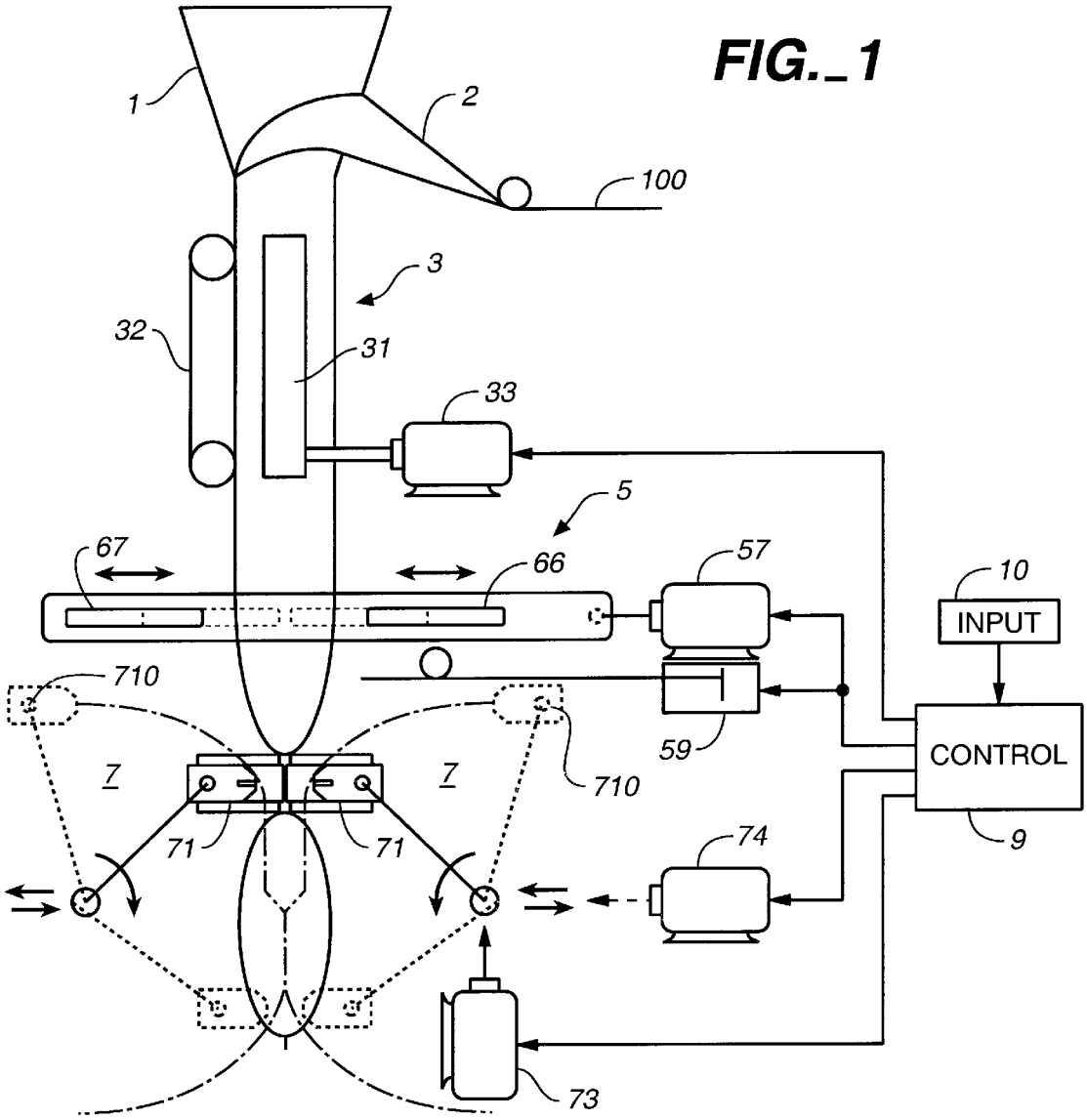
FIG. 1 is a schematic representation, in part as a block diagram, of a packaging machine which makes use of a method embodying this invention.

The invention is described next by way of an example. FIG. 1 shows schematically the structure of a packaging machine embodying this invention. An elongated bag-making material (the "film") 100 is transported to a former 2 to be thereby bent into a tubular form around a tubular structure which is integrally formed with a hopper 1, and is pulled down along this tubular structure by means of a pair of pull-down belts 31 (only one of the pair being visible in FIG. 1) driven by a belt-driving motor 33 controlled by a control unit 9. The pair of pull-down belts 31 and a longitudinal sealer 32, comprising a heater to seal together the mutually overlapping side edges of the film 100, together form a pull-down mechanism 3, disposed below the former 2.

Disposed below this pull-down mechanism 3 and immediately above a transverse sealer 7 is a shaker 5 for causing the articles being dropped from a weigher (not shown) into the interior of the bag in the making, while clamping the tubularly formed film 100 in a coordinated way with the operation of the weigher such that the volume density of the articles will be increased. The transverse sealer 7 is for sealing the tubularly formed film 100 in the transverse direction and comprises a pair of seal jaws 71 and jaw-operating motors 73 and 74 controlled by a control unit 9 for causing the pair of seal jaws 71 to undergo a cyclic motion along generally D-shaped trajectories, as disclosed more in detail, for example, in U.S. Pat. No. 5,753,067. Numeral 10 indicates an input device through which a user may input "packaging conditions", such as the length of the bags to be produced, the target weight of articles to be packaged in each bag, the packaging speed or the number of packages to be produced per unit time, on which operations of various kinds are to be carried out. direction and comprises a pair of seal jaws 71 and jaw-operating motors 73 and 74 controlled by a control unit 9 for causing the pair of seal jaws 71 to undergo a cyclic motion along generally D-shaped trajectories, as disclosed more in detail, for example, in U.S. Pat. No. 5,753,067. Numeral 10 indicates an input device through which a user may input "packaging conditions", such as the length of the bags to be produced, the target weight of articles to be packaged in each bag, the packaging speed or the number of packages to be produced per unit time, on which operations of various kinds are to be carried out.

Explained more in detail, the shaker 5 is adapted to clamp a portion of the film 100 periodically, once every time the film 100 is pulled down by a distance equal to the length of the bags being made. In a mode of operation wherein articles with a desired total weight are dropped successively in two batches to produce a packaged bag, for example, the shaker 5 shakes the articles of the first batch which are dropped in first, thereby increasing their volume density. The shaker 5 then releases the clamping as articles of the second batch are dropped into the film 100. As a result, the articles fill the interior of the tubularly formed film 100 at an increased volume density with the bottom of the bag sealed transversely.

Figure 2A:
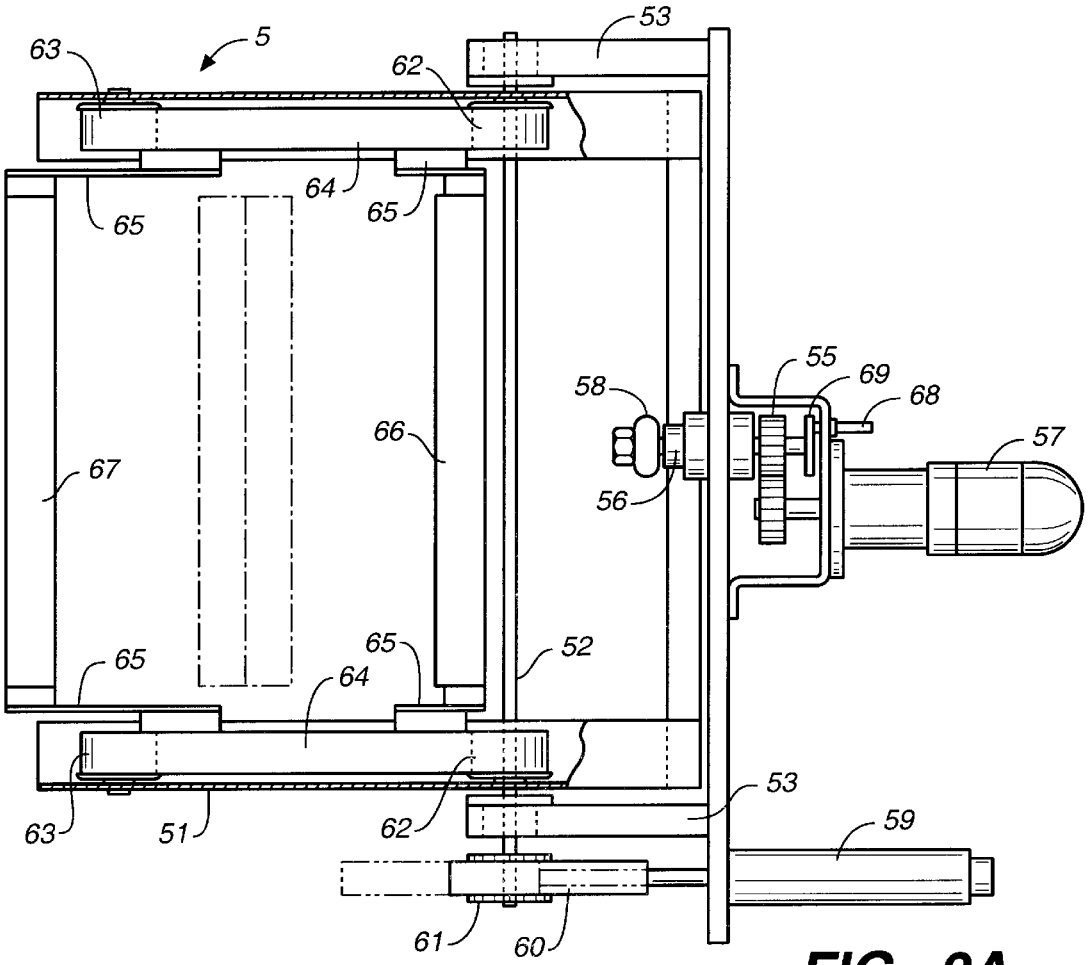
FIGS. 2A and 2B are respectively a plan view and a side view of the shaker of the packaging machine of FIG. 1.
Figure 2B:
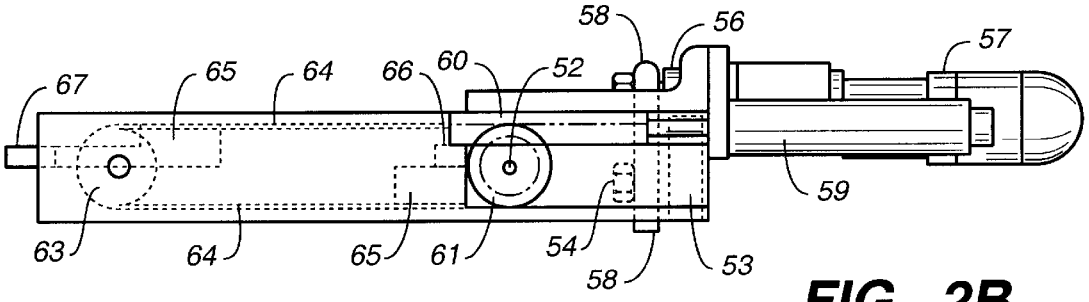

FIGS. 2A and 2B show the structure of this shaker 5 more in detail. Its main body (the "shaker main body") 51 is in the form of a frame, surrounding the tubularly formed film 100, and is attached to a pair of left-hand side and right-hand side frame structures 53 through a shaft 52 penetrating the shaker main body 51 in the direction of its width (the vertical direction in FIG. 2A) so as to be able to oscillate. At one end of the shaker main body 51 in its longitudinal direction (the horizontal direction in FIG. 2A) is a longitudinally extending shaft 54 which is eccentrically coupled through a connecting bar 58 with the shaft 56 of a decelerating gear 55 such that the rotary motion of a shaker motor 57 for shaking, controlled by the control unit 9, is converted into an up-and-down motion such that the main body 51 will undergo an oscillatory motion in the vertical direction around the shaft 52.

A pinion 61 is affixed to one end of this shaft 52 penetrating the shaker main body 51, engaging a rack 60 which is adapted to be driven by a driver cylinder 59, controlled by the control unit 9, to undergo a reciprocating forward-backward motion in the longitudinal direction. A belt 64 is supported between a driver pulley 62 affixed to the shaft 52 and a follower pulley 63 on the shaker main body 51. A pair of shutters 66 and 67 is attached to the mutually oppositely facing surfaces of this belt 64 such that these shutters 66 and 67 can be moved towards or away from each other by moving the rack 60 backward and forward to move the belt 64.

In FIG. 2, numeral 68 indicates a sensor for counting the number of oscillations of the shaker main body 51 by detecting a plate 69 attached to the shaft 56 of the decelerating gear 55. The control unit 9 serves to control the operations of the motions of the motors 33, 57, 73 and 74 for the pull-down belts 31, the shaker main body 51 of the shaker 5 and the transverse sealer 7. The timing for the control of these motors by the control unit 9 is explained next with reference to sketches in FIGS. 3A, 3B, 3C, 3D, 3E and 3F, as well as the timing chart of FIG. 4.

If the packaging speed inputted through the input device 10 is greater than a preselected specified value ("specified packaging speed") preliminarily stored in the control unit 9, or if articles to be packaged together to make one package are dropped together all at one as a single batch according to a selected mode of operation, the control unit 9 carries out a normal continuous mode of film transportation, transporting the film 100 in a continuous manner without shaking the articles which have been dropped in. If the inputted packaging speed through the input device 10 is less than the specified packaging speed, or if the articles with a target total weight are dropped successively in a plurality of batches according to a selected mode of operation, on the other hand, the control unit 9 advances the film 100 intermittently by a distance equal to the length of the individual bags to be made.

Figure 3A:
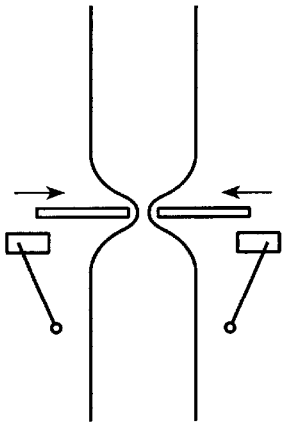
FIGS. 3A, 3B, 3C, 3D, 3E and 3F are schematic drawings for showing the sequence of packaging operations by the packaging machine of FIG. 1 in an intermittent mode of film transportation.
Figure 3B:
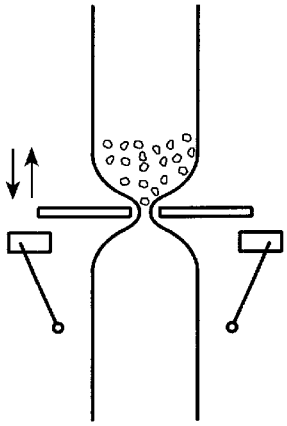
Figure 3C:
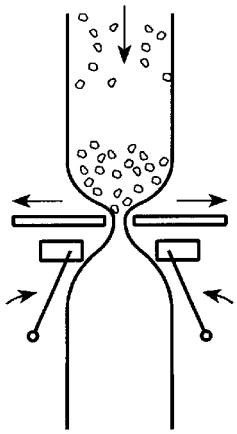
Figure 3D:
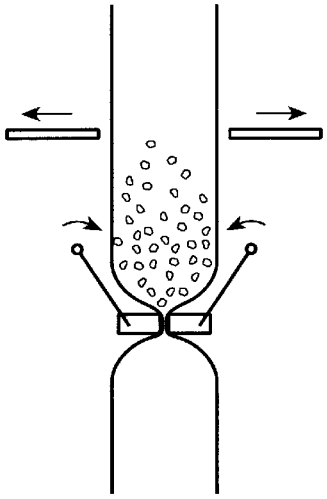
Figure 4:
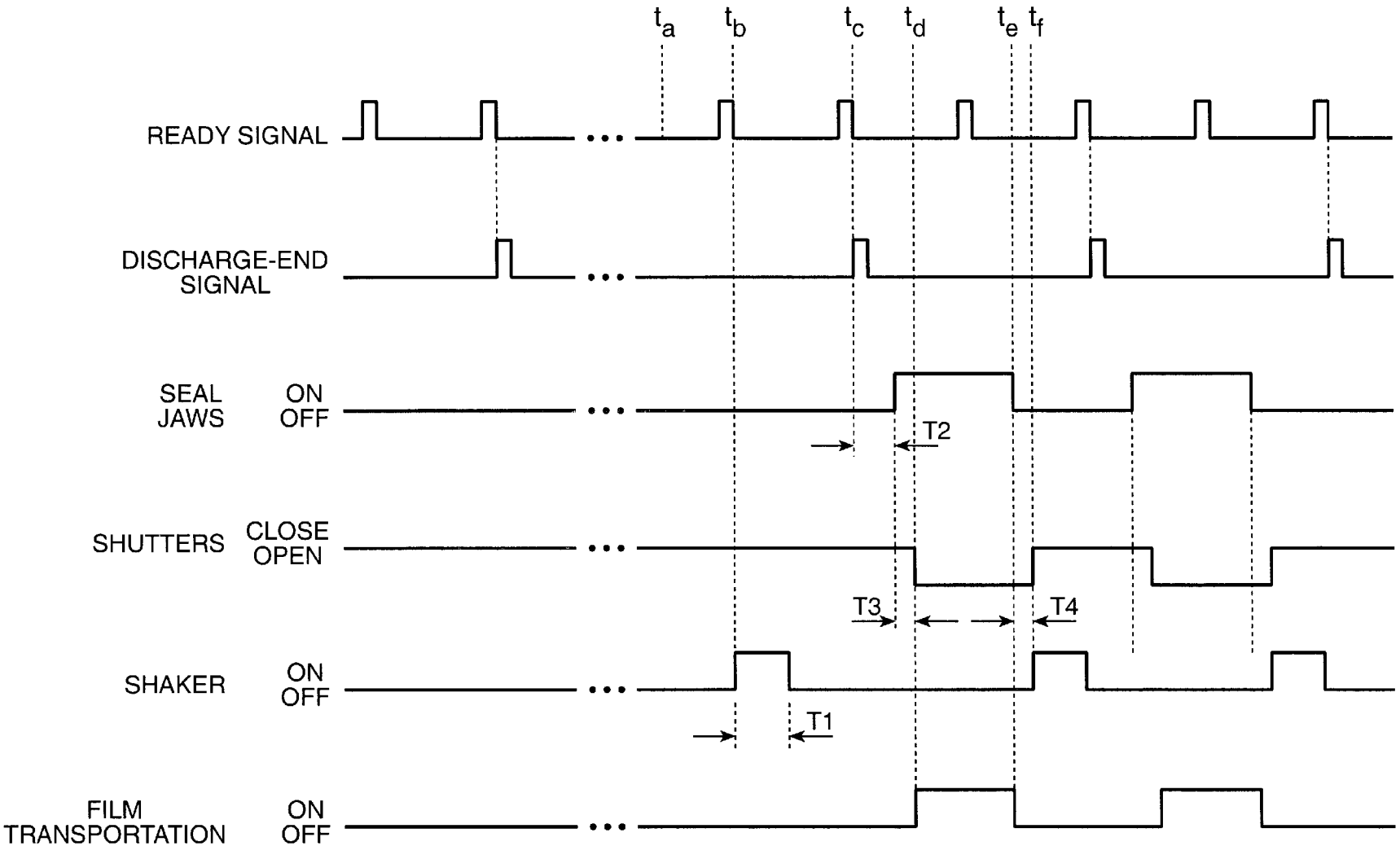
FIG. 4 is a timing chart for the packaging operations of FIGS. 3A, 3B, 3C, 3D, 3E and 3F.

Let us now consider a mode of operation wherein articles having a target total weight are dropped successively in two batches, each weighing about one half of the target weight. This mode of operation is described, for example, in U.S. Pat. No. 4,508,185 and hence will not be described herein in detail. After a cycle of operations including weighing and packaging (say, at time $t_a$ in FIG. 4), the seal jaws 71 of the transverse sealer 7 are stopped at specified initial positions (indicated by numeral 710 in FIG. 1) immediately before they contact each other, the shutters 66 and 67 of the shaker 5 are stationary while clamping the tubularly formed film 100 as shown in FIG. 3A, and the pull-down belts 31 are at rest. When the weigher receives a ready signal from the packaging machine under this condition, requesting a discharge of weighed articles, a batch of articles with a total weight equaling about one half of the target total weight is measured and dropped into the tubularly formed film 100 in a clamped condition, and the shaker motor 57 rotates for a specified length of time T1 (from time $t_b$ in FIG. 4), causing the shaker main body 51 to oscillate up and down around the shaft 52 so as to increase the volume density of the articles which have been dropped, as shown in FIG. 3B. Thereafter, when a second batch of articles weighing also about one half of the target total weight (such that the sum of the weights of the first and second batches of articles equals the target total weight) is dropped from the weigher as shown in FIG. 3C in response to another ready signal outputted from the packaging machine and a discharge-end signal indicative of the completion of a discharge of articles is returned from the weigher at time $t_c$, the motors 73 and 74 for the seal jaws 71 begin to rotate after a short wait period of T2. After still another period of time T3 (at time $t_d$), the seal jaws 71 engage each other immediately before the articles of the second batch reach the shaker 5 and seal the bottom edge of the bag being formed. At the same time (at time $t_d$), the downward motion of the film 100 is started in synchronism with the rotary motion of the seal jaws 71 and the driver cylinder 59 is also activated so as to cause the pair of shutters 66 and 67 to move away from each other through the rack 60, the pinion 61 engaging with the rack 60, the driver pulley 62 which rotates with the pinion 61, and the belt 64 stretched between the driver pulley 62 and the follower pulley 63. As a result, the articles of the first batch of which the volume density has been increased by the shaker 5 and the articles of the second batch received subsequently are together dropped into the bag being formed with its bottom edge sealed between the seal jaws 71, as shown in FIG. 3D.

Figure 3E:
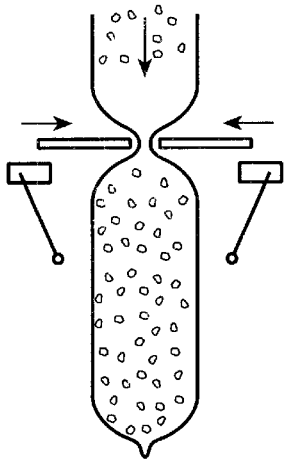
Figure 3F:
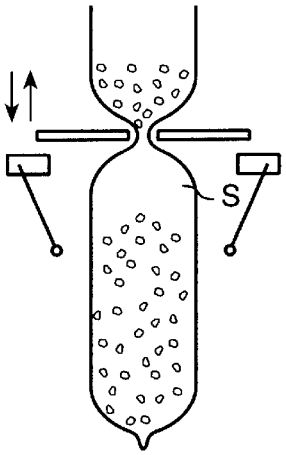

The film 100 is pulled down by the pull-down belts 31 at the same speed as the downward motion of the seal jaws 71 on the straight line portions of their generally D-shaped trajectories. By time $t_e$, when the film 100 is pulled down by a distance equal to the length of the bag being made, the first and second batches of the articles are together completely inside and the seal jaws 71 are back at their specified initial positions 710, as shown in FIG. 3E. After the downward motion of the film 100 is also stopped around the same time, the shutters 66 and 67 wait for a specified period T4 until the dropped articles settle and then clamp the film 100 above these articles. At the same time $t_f$, the shaker 5 is activated again as shown in FIG. 3F, causing the shaker main body 51 to oscillate around the shaft 52 up and down so as to increase the volume density of not only the articles of the second batch already inside the closed bag but also the next batch of articles dropped in the meantime for the next bag to be produced. Thus, a space is created above the enclosed articles for transversely sealing the film 100 with the seal jaws 71, and the sequence of steps described above is repeated thereafter.

Let us consider next a situation wherein the film 100 is pulled down in a continuous manner and articles having a target total weight are dropped in together as a single batch.

Figure 5A:
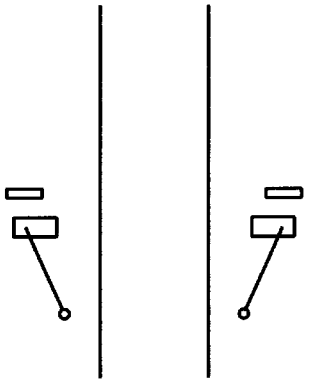
FIGS. 5A, 5B, 5C, 5D and 5E are schematic drawings for showing the sequence of packaging operations by the packaging machine of FIG. 1 in a continuous mode of film transportation.
Figure 5B:
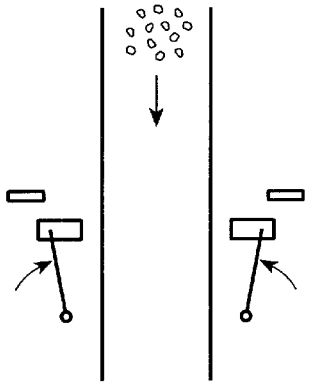
Figure 5C:
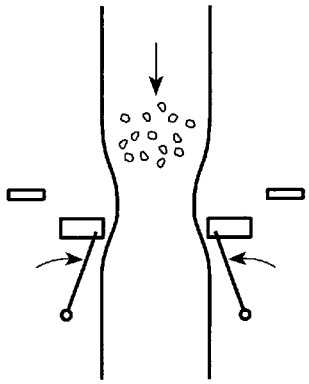
Figure 5D:
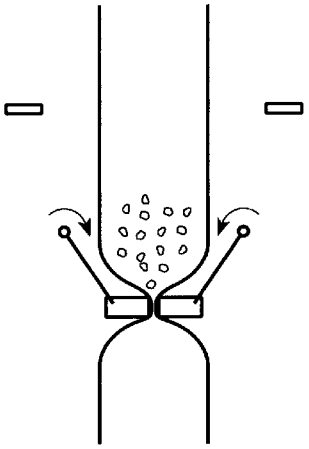
Figure 5E:
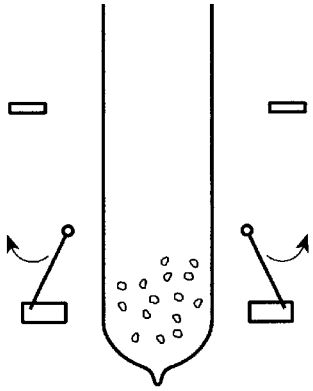
Figure 6:
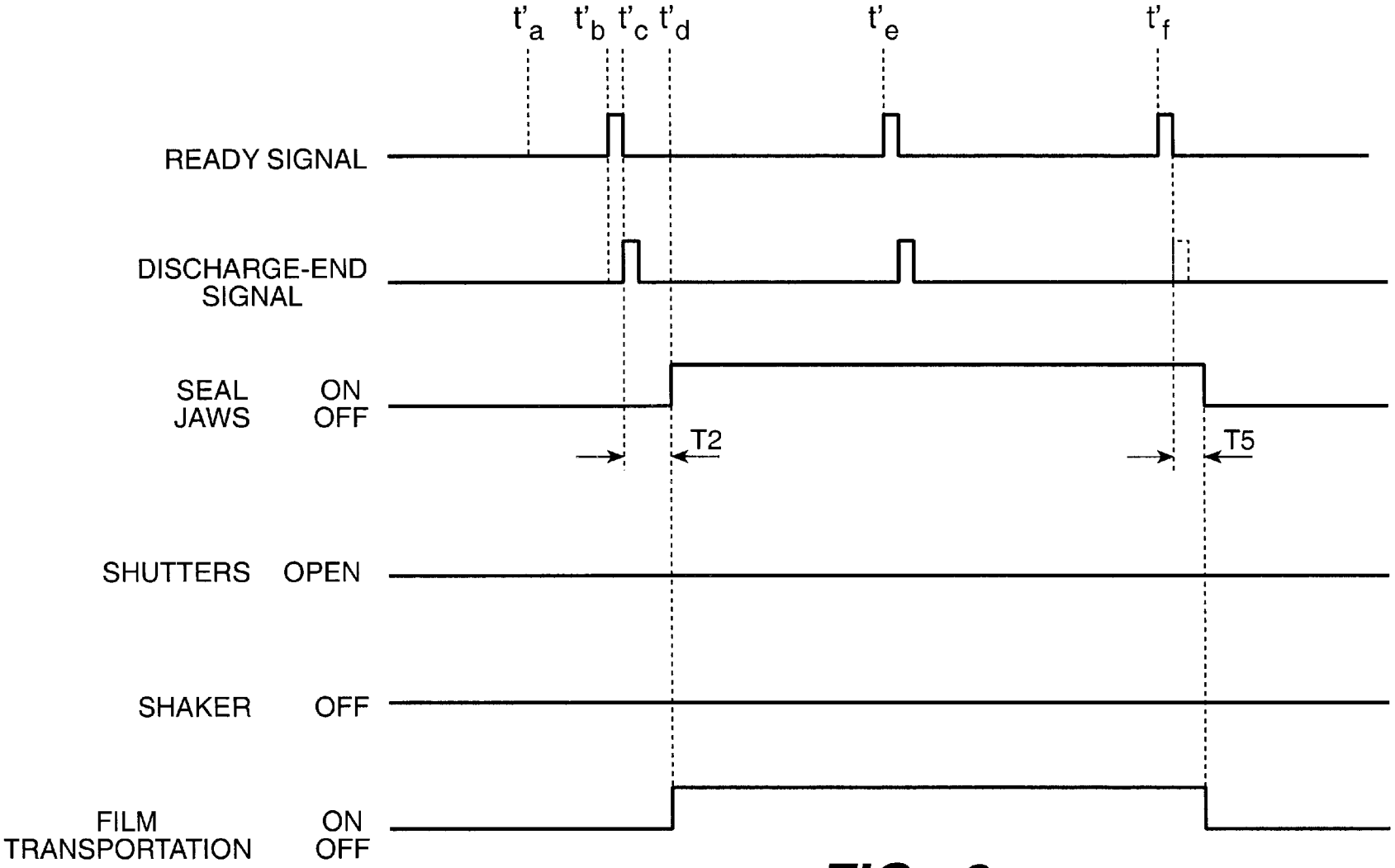
FIG. 6 is a timing chart for the packaging operations of FIGS. 5A, 5B, 5C, 5D and 5E.

In this mode of operation, the shutters 66 and 67 remain open and the shaker 5 is kept inactive. FIG. 5A shows a situation at time $t'_a$ as shown in FIG. 6 prior to the output of a ready signal. If a ready signal is outputted from the packaging machine (at time $t'_b$ in FIG. 6) under this condition and the weigher discharges weighed articles in a single batch and outputs a discharge-end signal (at time $t'_c$ in FIG. 6), the control unit 9 causes the jaw-operating motors 73 and 74 to start moving the seal jaws 71 and the belt-driving motor 33 to start pulling down the film 100 after waiting for a predetermined period of time T2 (at time $t'_d$) as shown in FIGS. 5B and 5C such that the seal jaws 71 close the bag in time to receive the article batch thereabove, as shown in FIG. 5D. Thereafter, the seal jaws 71 continue to rotate and the film 100 continues to move down as shown in FIG. 5E, and the seal jaws 71 transversely seal the film 100 to form simultaneously the top seal of the bag which has just been filled and the bottom seal of the bag to be filled in the next cycle of operation. If the next ready signal is thereafter outputted from the packaging machine (at time $t'_e$) and a discharge-end signal is received from the weigher in response, the pull-down belts 31 is continuously rotated and the seal jaws 71 are caused to undergo another cycle of rotary motion at the same time, as described above. If no discharge is made and no discharge-end signal is accordingly outputted from the weigher, for whatever reason, as indicated by a dotted line at time $t'_f$ in FIG. 6, the control unit 9 causes the seal jaws 71 to complete the transverse sealing to thereby close the top end of the bag which has just been filled in the previous cycle of operation and to return to, and to rest at, their specified initial positions 710, stopping the pull-down belts 31 after a predetermined period of time T5 has elapsed from the moment when a discharge-end signal was normally to be received, as shown in FIG. 6.

Although the invention has been described above for a mode of operation wherein articles with a target total weight are dropped in two batches to make each package, the articles of the first batch being shaken after being dropped such that their volume density is increased before the articles of the second batch are dropped, this is not intended to limit the scope of the invention. In general, articles with a target total weight may be dropped consecutively in n batches where n may be any integer equal to or greater than 2, and the bag may be shaken by the shaker after articles of each of the first (n−1) batches have been dropped. Articles of all n batches are added together to form one package only after the articles of the $n^{th}$ batch (the "final batch") are dropped.

Thus, the bag is shaken after each time articles of one of the first (n−1) batches are dropped such that their volume density is increased, and the bag is finally sealed and shut after the final batch of articles is dropped in. In this manner, packages with a smaller volume can be produced according to this invention such that their costs of production as well as of transportation can be significantly reduced. Since this operation for increasing the volume density of the articles is carried out simultaneously with the transverse sealing of the film, the packaging speed is not adversely affected. In a mode of operation wherein the tubularly formed film is transported intermittently, furthermore, the speed of film transportation can be increased to thereby increase the distance along which the film is stroked such that the so-called browsing effect can be enhanced.

The disclosure given above is intended to be interpreted broadly. It goes without saying that the packaging machine of this invention can be operated not only with a weigher adapted to drop in article batches according to their weights but also with a device adapted to supply article batches according to their volumes or number of individual articles.

What is claimed is:

1. A packaging method comprising the steps of:

clamping a tubularly formed film transversely at a clamping position with a shaker to prevent articles from passing across said clamping position;

dropping batches of said articles sequentially into said film from above said clamping position while said film is in a clamped condition by said shaker;

shaking the articles above said clamping position by means of said shaker after each of said batches has been dropped into said film to thereby increase volume density of said articles inside said tubularly formed film;

releasing said film from said clamped condition to thereby further drop the shaken articles past said clamping position after articles of a final batch are dropped into said film; and thereafter sealing said tubularly formed film transversely above the dropped articles.

2. The packaging method of claim 1 further comprising the steps of preliminarily specifying a reference packaging speed and inputting a target packaging speed at which packages of said articles are produced by said packaging method; and comparing said target packaging speed with said reference packaging speed by means of a control unit so that the steps of claim 1 are carried out and said film is transported intermittently each time by a specified bag length if said target packaging speed is less than said reference packaging speed, and that said film is transported continuously and said shaker is inactive if said target packaging speed is greater than said reference packaging speed.

3. The packaging method of claim 1 further comprising the steps of:

preliminarily storing a reference value;

inputting packaging conditions for producing packages through an input device;

comparing said reference value with said packaging conditions by means of a control unit and thereby selecting a mode of operation from the group consisting of continuous mode and intermittent mode;

transporting said film intermittently each time by a bag length according to said packaging conditions and carrying out the steps of claim 1 if said intermittent mode has been selected; and transporting said film continuously while keeping said shaker inactive if said continuous mode has been selected.

4. The packaging method of claim 1 wherein said shaker shakes said film in an up-and-down motion.

5. A packaging method comprising the steps of:

intermittently transporting a tubularly formed film;

clamping said tubularly formed film transversely at a clamping position with a shaker to prevent articles from passing across said clamping position;

dropping a first batch of said articles which is about one half of a predetermined target total quantity into the clamped tubularly formed film from above said clamping position;

shaking said first batch of articles above said clamping position by means of said shaker;

thereafter dropping a second batch of articles from above said clamping position into said tubularly formed film, releasing said clamped tubularly formed film and thereby allowing said first batch and said second batch of articles to drop past said clamping position and transversely sealing said tubularly formed film below said clamping position to form a bottom of a bag, said first batch and said second batch of articles together being of said target total quantity;

thereafter stopping the transportation of said tubularly formed film;

thereafter similarly clamping said tubularly formed film with said shaker at a next clamping position on said film;

thereafter dropping another first batch of articles from above said next clamping position into the clamped tubularly formed film; and thereafter shaking simultaneously both said another first batch of articles above said next clamping position and said first batch and said second batch of articles below said next clamping position on said tubularly formed film.

6. The packaging method of claim 5 wherein said tubularly formed film is transported along a film path and said shaker is disposed on said film path.

7. The packaging method of claim 5 wherein said shaker shakes said film in an up-and-down motion.

* * * * *